US005733409A

United States Patent [19]

Turnbull et al.

[11] Patent Number: 5,733,409

[45] Date of Patent: Mar. 31, 1998

[54] LABEL APPLICATOR

[76] Inventors: Andrew Turnbull, 44 Charles Street W., Unit 2109, Toronto, Ontario M4Y 1R7; Alan Metcalfe, 60 Hanson Road, Unit 10, Mississauga, Ontario L5B 2P6, both of Canada

[21] Appl. No.: 486,529

[22] Filed: Jun. 7, 1995

[51] Int. Cl.[6] ..... B65C 3/02; B65C 9/26; B65C 9/36

[52] U.S. Cl. ..... 156/423; 156/493; 156/574; 156/579; 156/583.3; 156/DIG. 6; 156/DIG. 37; 156/DIG. 42

[58] Field of Search ..... 156/156, 215, 156/285, 287, 293, 382, 391, 423, 443, 475, 493, 538, 539, 574, 579, 580, 583.3, DIG. 5, DIG. 6, DIG. 8, DIG. 9, DIG. 10, DIG. 12, DIG. 31, DIG. 37, DIG. 41, DIG. 42, DIG. 48; 264/511; 100/269.03

[56] References Cited

U.S. PATENT DOCUMENTS

| | | | |
|---|---|---|---|
| Re. 23,668 | 6/1953 | Von Hofe . | |
| 1,705,512 | 3/1929 | Warga . | |
| 2,106,864 | 2/1938 | Balton . | |
| 2,124,670 | 7/1938 | Johnson . | |
| 2,331,743 | 10/1943 | Sullivan . | |
| 2,396,413 | 3/1946 | Egger . | |
| 2,425,450 | 8/1947 | Young | 156/443 |
| 2,753,071 | 7/1956 | Walker . | |
| 2,865,640 | 12/1958 | Watson et al. . | |
| 3,316,127 | 4/1967 | Oswald . | |
| 3,376,184 | 4/1968 | Ritchey et al. | 156/580 |
| 3,554,834 | 1/1971 | Bennett et al. | 156/285 |
| 3,579,400 | 5/1971 | Kanyok et al. | 156/294 |
| 4,026,755 | 5/1977 | Gossie | 156/574 |
| 4,080,243 | 3/1978 | Pohl | 100/269.03 |
| 4,337,105 | 6/1982 | Stachiw et al. | 156/293 |
| 4,704,183 | 11/1987 | Sigerist | 156/475 |
| 5,100,491 | 3/1992 | Ijiri et al. . | |
| 5,173,148 | 12/1992 | Lisec . | |
| 5,322,653 | 6/1994 | Muller | 156/156 |
| 5,427,518 | 6/1995 | Morizot et al. | 156/583.3 |

FOREIGN PATENT DOCUMENTS

| | | | |
|---|---|---|---|
| 2607779 | 6/1988 | France | 156/DIG. 5 |
| 182233 | 7/1989 | Japan | 156/DIG. 37 |
| 18236 | 1/1992 | Japan | 156/DIG. 8 |
| 56136 | 3/1994 | Japan | 156/DIG. 37 |
| 323054 | 12/1929 | United Kingdom | 156/287 |

*Primary Examiner*—Steven D. Maki
*Attorney, Agent, or Firm*—Kolisch, Hartwell, Dickinson, McCormack & Heuser

[57] ABSTRACT

An applicator for applying a label to the interior surface of a hollow body is provided. The applicator includes an applicator rod, which is connected to a source of negative pressure and is adapted to retain the label by means of the negative pressure. The applicator rod co-operates with an inflatable member. The inflatable member is positioned so as to force a label that is retained on the applicator rod against the inner surface of the hollow body when the applicator rod is inserted into the hollow body via an opening and the inflatable member is inflated. The inner surface of the hollow body and the label co-operate so that the label will adhere to the inner surface as the label is forced against this surface. The applicator is particularly well suited for use in a bicycle registration system. Used in such a system, the applicator functions to apply a label which adheres to the interior tube of a bicycle frame. The label may convey information, for example providing details relating to the ownership of the bicycle. In the event of recovery of the bicycle after loss or theft, the label may be read with a known type of reading device suitable for the same, such as a bore scope.

8 Claims, 9 Drawing Sheets

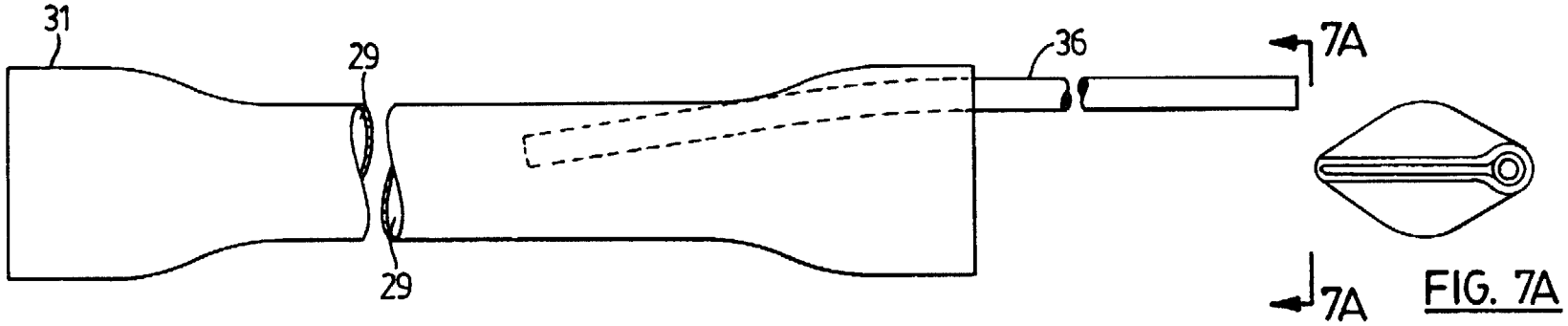
FIG. 7A
FIG. 7
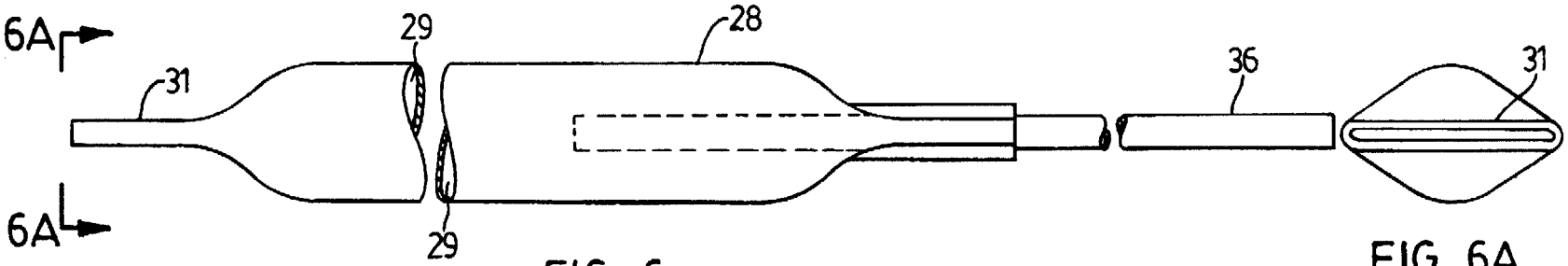
FIG. 6A
FIG. 6

LABEL APPLICATOR

FIELD OF THE INVENTION

This invention relates to an apparatus and method for applying a label to the interior surface of a hollow body with at least one opening. The method and apparatus are particularly suited for applying identification labels to the interior of tubes forming a part of bicycle frames.

BACKGROUND OF THE INVENTION

Devices and methods adapted to apply a label to a variety of surfaces are known.

For example, U.S. Pat. Re. 23,668 issued Jun. 16, 1953 to G. W. Van Hofe discloses an apparatus for applying labels to articles whose configuration makes it desirable that the label be shaped before it is mounted. Specifically, this patent discloses an apparatus which retains a label and whose shape substantially conforms to the shape of the surface to which the label is to be applied. Moreover, the apparatus uses suction to retain the label on the applicator. The label is applied by forcing the applicator against the surface to which the label is to be applied.

U.S. Pat. No. 2,753,071 issued Jul. 3, 1956 to W. K. Walker discloses a method and apparatus for applying labels to the inside of cores upon which filamentary members are wound preparatory to shipping. The patent discloses a mandrel for holding and applying labels which has apertures to which a vacuum is applied to hold a label for application. The mandrel is shaped to conform to the shape of the interior of the core. In operation, the label adheres to the core because an adhesive surface contacts the inner surface of the core with enough force applied through the mandrel to cause the label to adhere to the inner surface.

U.S. Pat. No. 2,124,670 issued Jul. 26, 1938 to J. B. Johnson discloses an apparatus for placing labels in ice cream cones. The patent discloses an applicator with hollow fingers which are operatively connected through a tubular frame to a suction pump. The suction pump creates a vacuum which retains the labels. To apply a label to an interior of a cone, the label is retained through suction by the applicator. The applicator is then pressed against the interior of the cone and the vacuum is released. Because the label is slightly moist, it tends to adhere to the interior of the cone.

Lastly, U.S. Pat. No. 5,100,491 issued Mar. 31, 1992 to T. Ijiri and S. Sakkiyama discloses a die for attaching labels to flexible articles. The die retains the label to be attached by vacuum means.

The known devices have disadvantages. For example, they do not address the difficulties inherent in the application of labels to interior surfaces of hollow bodies, where the desired point of label application is at some distance from the opening to the hollow body. Transmitting the required force to a point on the applicator where the label is positioned, so as to be able to force the label against a surface, is problematic. Moreover, it is difficult to precisely control the amount of force applied through the applicator. Where the label and surface are not visible, an operator may have limited assurance that a label has been properly adhered to the surface. These problems are particularly evident in the application of labels to the interior of long hollow tubes, such as those found in bicycle frames.

SUMMARY OF THE INVENTION

The present invention relates to an applicator for applying a label to the interior surface of a hollow body. The hollow body may be a bicycle frame. The applicator includes an applicator rod, which is connected to a source of negative pressure and is adapted to retain the label by means of the negative pressure. The applicator rod co-operates with an inflatable member. The inflatable member is positioned so as to force a label that is retained on the applicator rod against the inner surface of the hollow body when the applicator rod is inserted into the hollow body via an opening and the inflatable member is inflated. The inner surface of the hollow body and the label co-operate so that the label will adhere to the inner surface as the label is forced against this surface.

The invention is particularly well suited for use in a bicycle registration system. Used in such a system, the applicator functions to apply a label which adheres to the interior tube of a bicycle frame. The label may convey information, for example providing details relating to the ownership of the bicycle. In the event of recovery of the bicycle after loss or theft, the label may be read with a known type of reading device suitable for the same, such as a bore scope. The bicycle may thereafter be returned to its rightful owner.

According to one aspect of the present invention there is provided an applicator for applying a label to an interior surface of a hollow body having at least one opening, said label having a first non-adhesive surface and an opposite adhering surface for adhering said label to said interior surface of said hollow body, said applicator unit comprising: a rod comprising a shell defining a cavity for insertion into said hollow body through said opening, said shell comprising an outer surface, said shell outer surface having a hole extending therefrom into said cavity, said shell having a cut-away portion located substantially opposite said hole; means for generating a vacuum at said hole to retain a label on said outer surface of said rod; an inflatable bladder positioned in said cavity such that, when deflated, said rod when received in said opening may move freely in said hollow body, and when inflated, said bladder extends through said cut away portion to press against said interior surface, whereby a label at said hole is urged against a portion of said interior surface opposite thereto to adhere said label to said interior surface; means to inflate said inflatable bladder; means to deflate said inflatable bladder; whereby, when said label is retained at said hole with said non-adhesive surface of said label in contact with said outer surface of said rod, said label and said rod are received in said opening, and said inflatable bladder is inflated, said label may be adhered to said inner surface.

According to another aspect of the present invention, an applicator for applying a label to an interior surface of a hollow tube, said label having a first non-adhesive surface and an opposite adhering surface, said applicator comprising, a rod member having a shell enclosing a hollow, elongated cavity; said shell having an outer surface, at least one hole extending into said hollow cavity from said outer surface, and a cut-away portion located substantially opposite said at least one hole; a vacuum line extending along and within said hollow cavity of said rod, said vacuum line having at least one opening adapted to overlap said at least one hole in said shell; a vacuum source for, with said vacuum line, generating a vacuum at said at least one hole to retain a label on said outer surface of said rod; an inflatable bladder extending along and within said hollow cavity; and means to inflate said inflatable bladder from a first deflated state wherein said rod may be received in and move freely within said hollow tube, to a second inflated state wherein said inflatable bladder extends from said cut-away portion such that a label retained on said outer surface by a vacuum is forced against said interior surface of said hollow tube.

BRIEF DESCRIPTION OF THE DRAWINGS

The above and still further objects, features, and advantages of the present invention will become apparent upon consideration of the following detailed description of specific embodiments of the invention, especially when considered in conjunction with the accompanying drawings, in which:

FIG. 6 is a side view of part of the applicator rod mentioned in FIG. 1.

FIG. 6A is an end view of the part shown in FIG. 6 along the line 6A—6A.

FIG. 7 is a plan view of the part shown in FIG. 6.

FIG. 7A is an end view of the part shown in FIG. 7 along the line 7A—7A.

DETAILED DESCRIPTION

Figure 1:
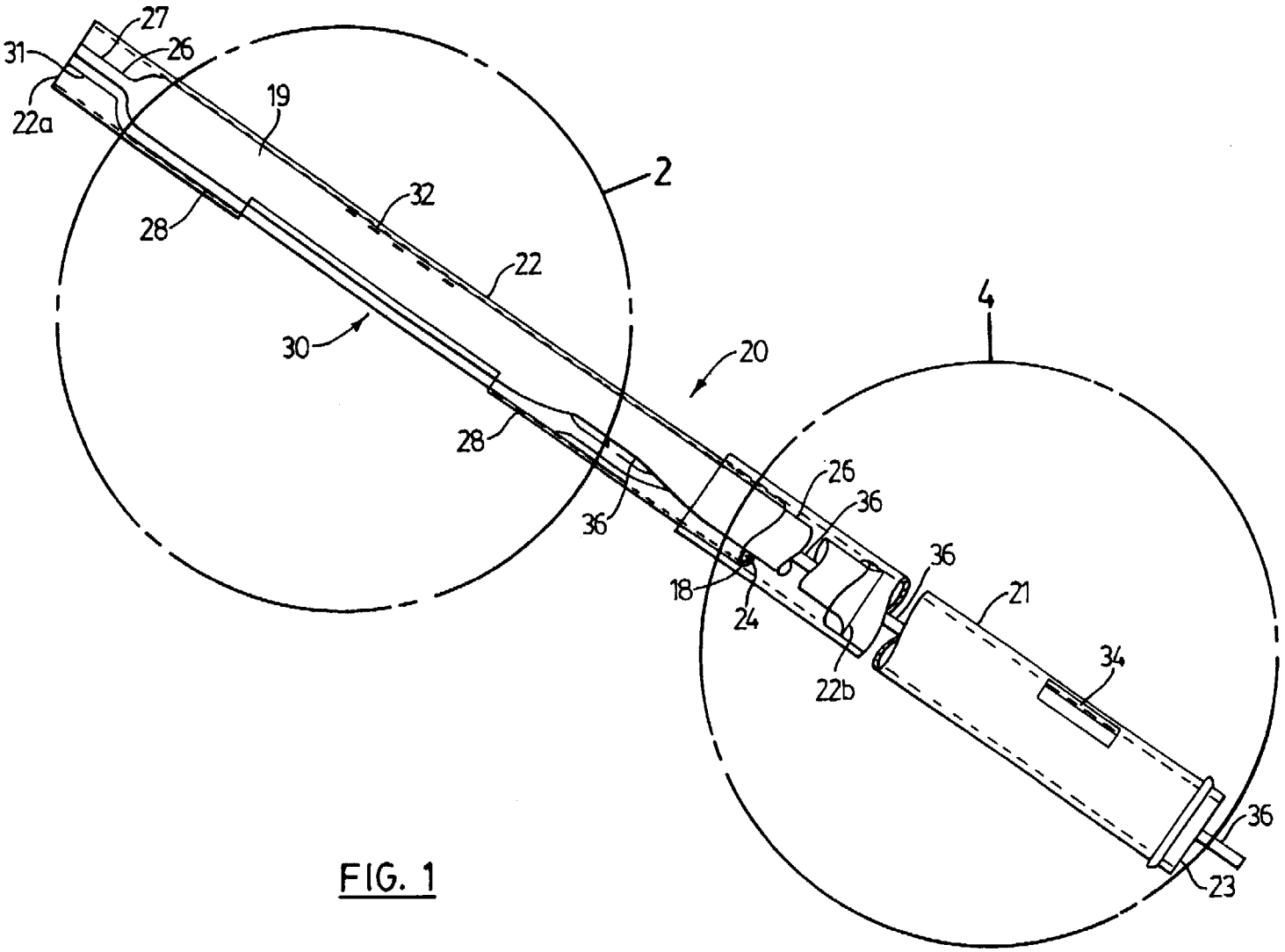
FIG. 1 is a side view of an applicator rod, made in accordance with one embodiment of the present invention.

With reference to FIGS. 1, 2, 2A, 3, and 3A illustrated is an applicator rod generally numbered as 20, having a hollow, cylindrical shell 22 defining a cavity 24. Shell 22 is formed of a rigid material such as steel or aluminum and has an exterior cylindrical surface 19 and a cylindrical interior surface 18. Shell 22 has a first end 22*a*, which may or may not be sealed. At an opposite end from first end 22*a* is a second end 22*b*. Shell 22 further has an opening 30 formed as a cut away portion of shell 22. A plurality of holes 32 in the shell 22 are located substantially opposite opening 30.

A hollow handle or grip 21 covers an end portion of shell 22 proximate end 22*b*, and extends away from end 22*b* of shell 22. Preferably grip 21 may be manually detached from shell 22. Grip 21 is also cylindrical in cross-section and defines a hollow passage 23 that extends the cavity 24.

A semi-rigid vacuum line 26 extends along an interior cavity 24 from proximate first end 22*a* of shell 22, to second end 22*b*. At end 22*a*, vacuum line 26 is sealed. At end 22*b*, line 26 flares continually to contact interior surface 18 of shell 22, and preferably a seal is created at end 22*b* between interior surface 18 of shell 22 and the exterior surface of vacuum line 26. The holes 32 of shell 22 extend into cavity 24 to provide for air communication between cavity 24 and the exterior surface of shell 22.

An inflatable bladder 28 extends along a portion of cavity 24. A portion of inflatable bladder 28 overlaps opening 30 of shell 22, and thus can expand through opening 30, when inflated. Inflatable bladder 28 is made of a resilient, deformable material such as rubber.

Figure 3A:
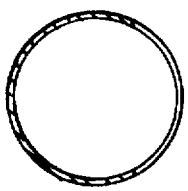
FIG. 3A is an end view of FIG. 3.
Figure 3:
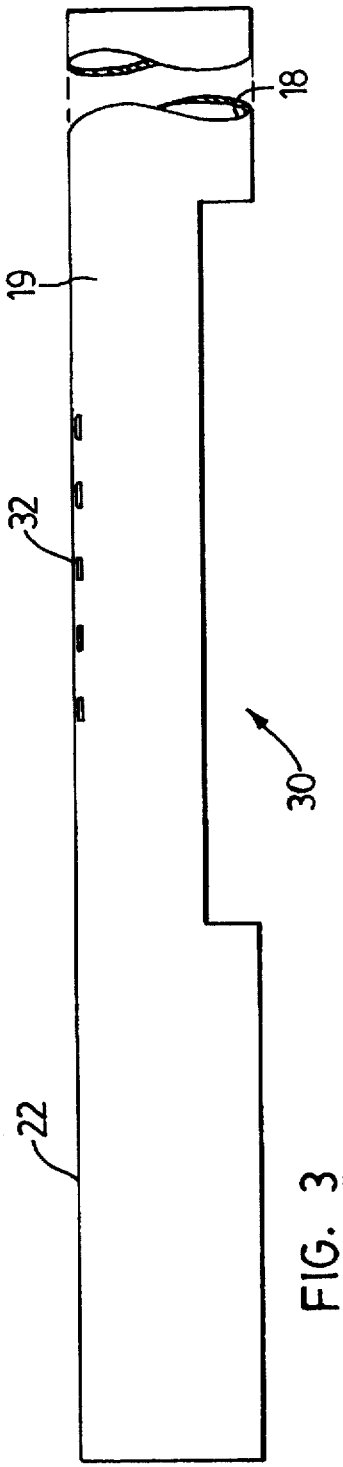
FIG. 3 is a side view of part of the applicator rod depicted in FIG. 1.
Figure 2A:
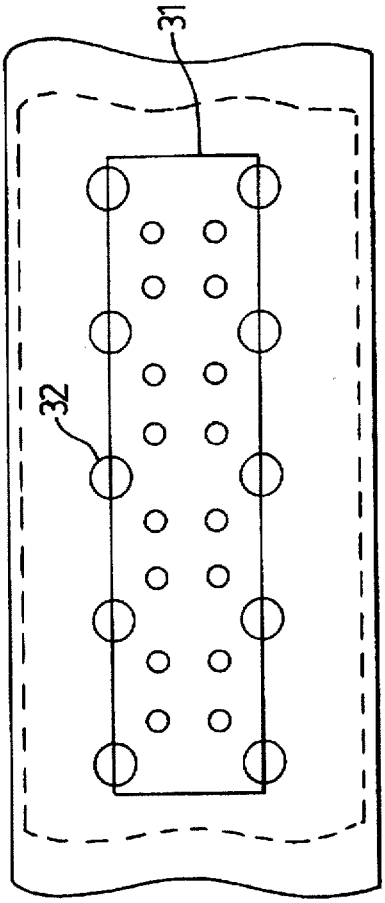
FIG. 2A is an enlargement of part of FIG. 2.
Figure 2:
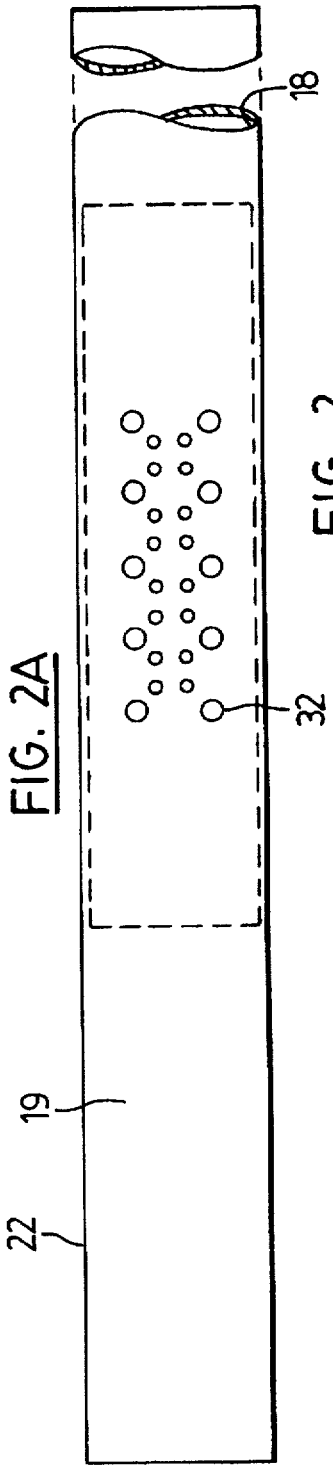
FIG. 2 is an enlarged plan view of that portion of the applicator rod of FIG. 1, marked as detail 2.

FIGS. 2, 2A and 3, illustrate that portion of the applicator rod 20 having a plurality of holes 32 on the exterior surface of shell 22. The holes 32 are arranged in a pattern such that a label 31 to be used with the applicator only covers a portion of those holes that are adjacent to the outer edges of label 31, as shown in FIG. 2A.

Figure 4A:
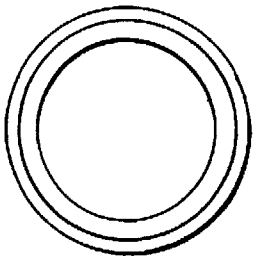
FIG. 4A is an end view of FIG. 4.
Figure 4:
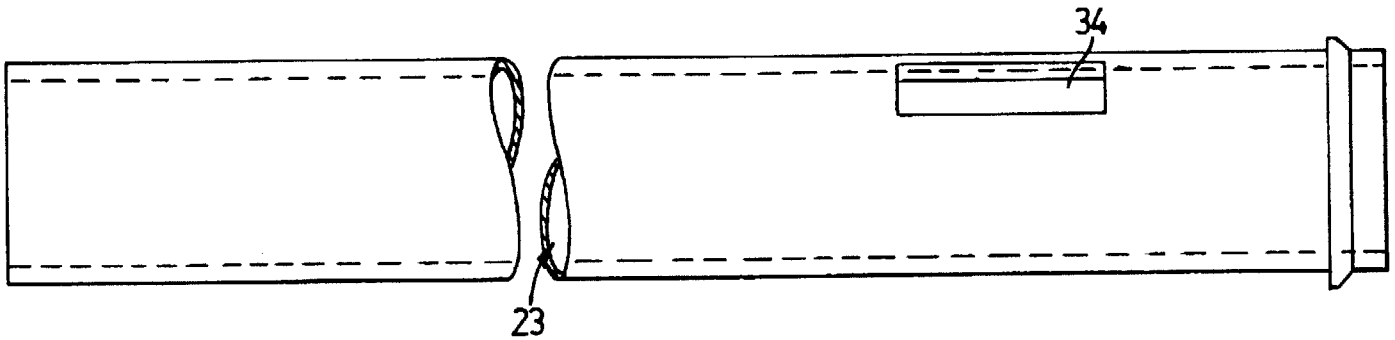
FIG. 4 is an enlarged side view of another part of the applicator rod of FIG. 1, marked as detail 4.
Figure 5:
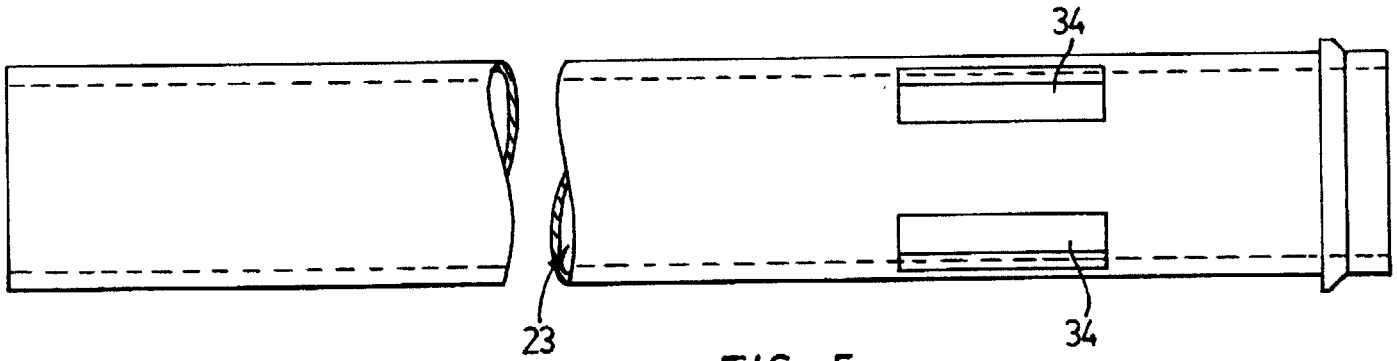
FIG. 5 is a plan view of the part shown in FIG. 4.

Turning to FIGS. 4 and 5, two views of grip 21 are shown, illustrating openings 34 in grip 21. Opening 34 provides for passage of air through the wall of grip 21.

The inflatable bladder 28 is shown in more detail in FIGS. 6, 6A, 7 and 7A. Inflatable bladder 28 is provided with a pinched end 31. An end view of bladder 28 showing pinched end 31 is illustrated in FIG. 6A. A hose 36 extends from inflatable bladder 28 for connection to inflation and deflation hose 66 (hereafter "inflation hose 66"). The connection between inflatable bladder 28 and hose 36 is air sealed and can withstand the air pressure when bladder 28 is inflated. This connection is more particularly illustrated in FIG. 7A.

Figure 8:
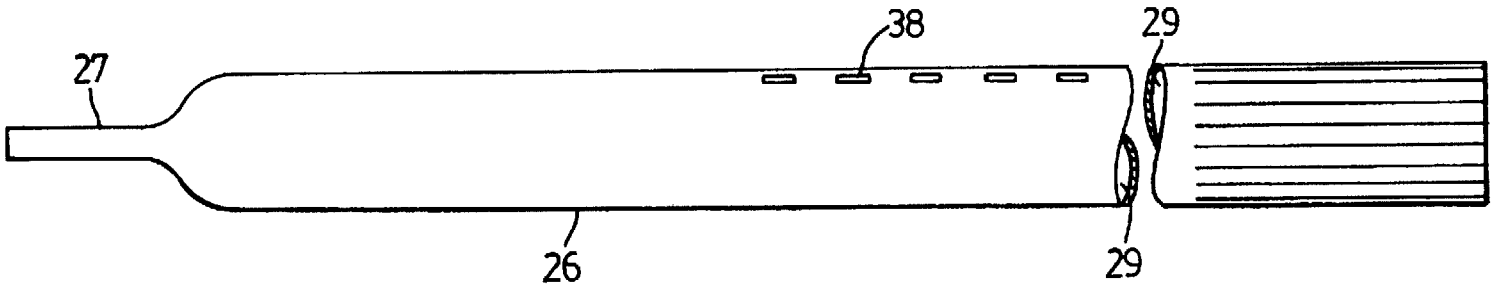
FIG. 8 is a side view of another part of the applicator rod of FIG. 1.
Figure 9:
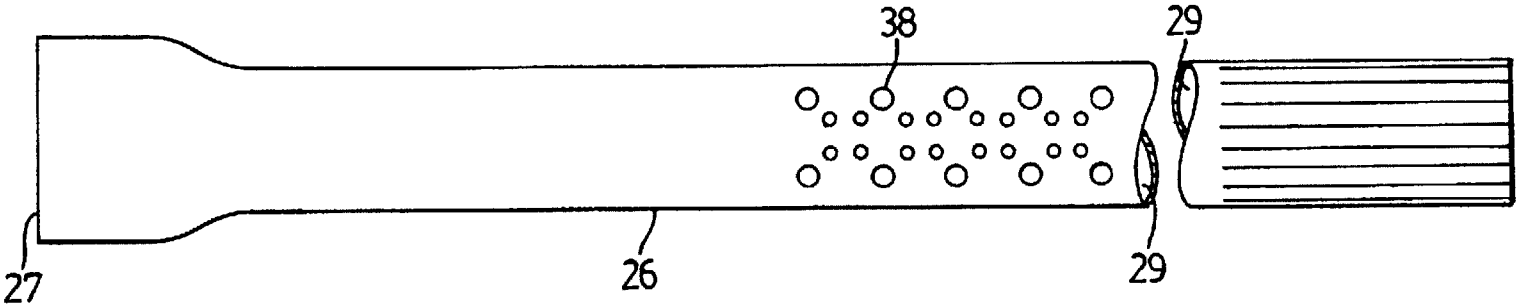
FIG. 9 is a plan view of the part shown in FIG. 8.

Vacuum line 26 is shown in more detail in FIGS. 8 and 9. It is provided with a closed end 27 and a plurality of openings 38 which are arranged in a pattern corresponding to the pattern of the plurality of holes 32 in shell 22. Assembled, vacuum line 26 is securely mounted in shell 22 and openings 38 are aligned so as to direct a vacuum through holes 32 to outer surface 19. Typically, vacuum line 26 is mounted in shell 22 before the plurality of holes 32 and plurality of openings 38 are formed. Holes 32 and openings 38 may be formed at the same time by drilling through exterior shell 22 and through vacuum line 26. Vacuum line 26 also has a hollow interior cavity 29 formed by the semi-rigid wall of vacuum line 26.

In the assembled applicator rod, hose 36 extends from bladder 28 towards end 22*b* of shell 22. At a position not shown, hose 36 passes through the semi-rigid wall of vacuum line 26 and into cavity 29 and then extends past end 22*b*, through the hollow interior 23 of grip 21.

Figure 10:
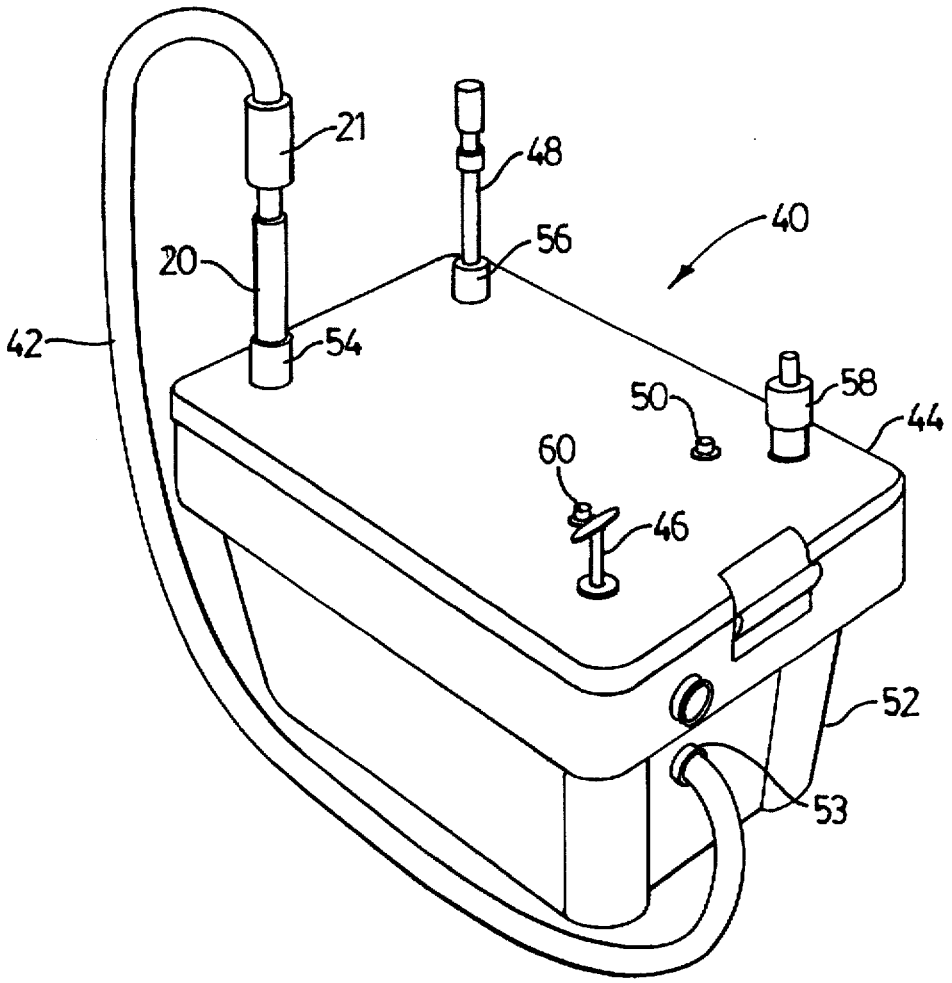
FIG. 10 is a perspective view of an applicator unit, made in accordance with one embodiment of the present invention.
Figure 11:
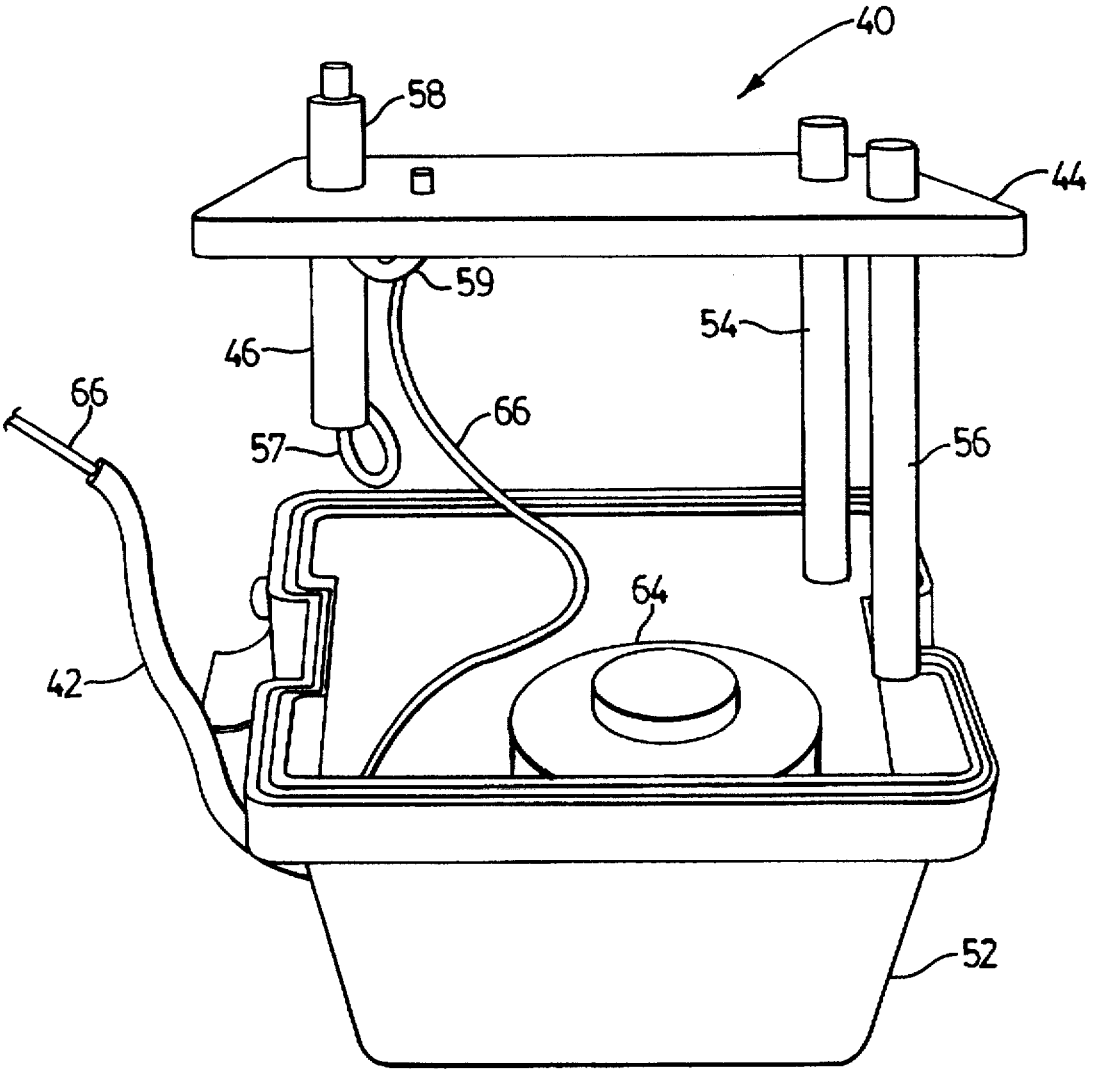
FIG. 11 illustrates the applicator unit of FIG. 10 with lid removed.
Figure 12:
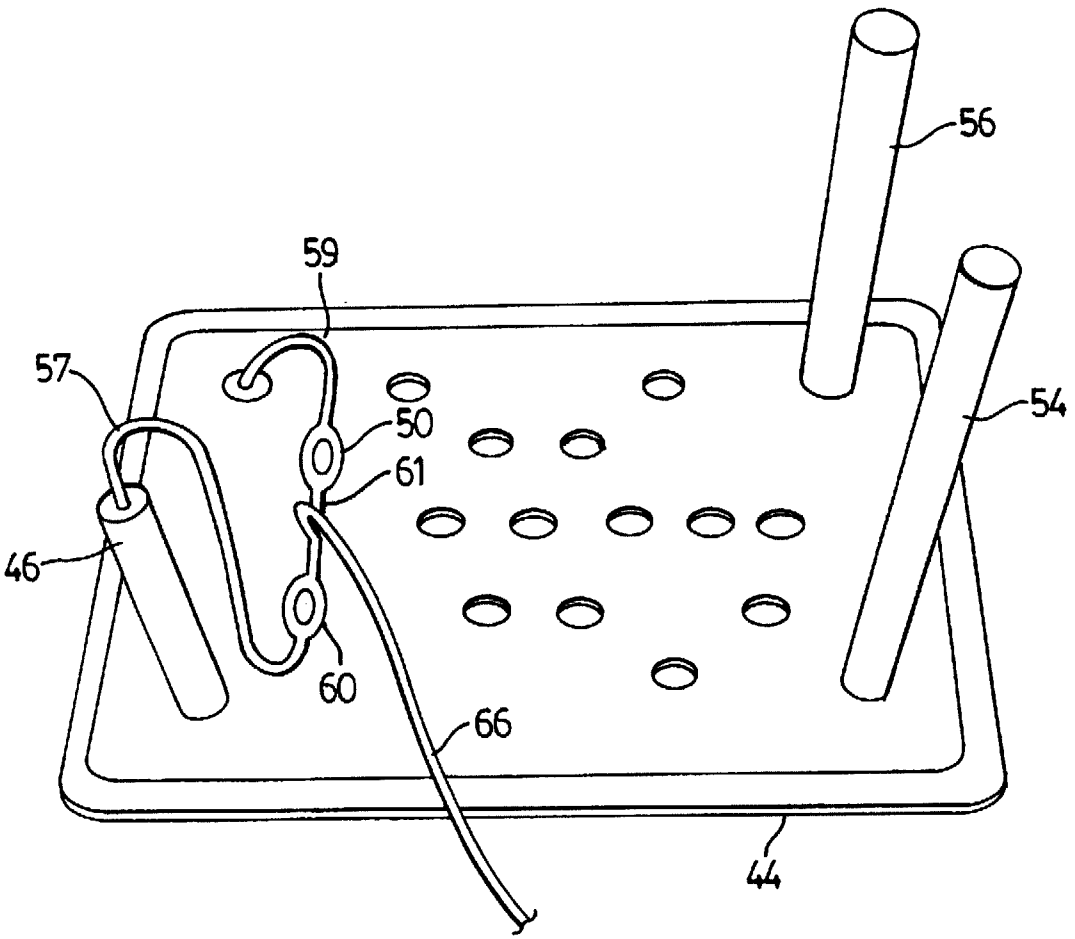
FIG. 12 illustrates a lid forming part of the applicator unit of FIGS. 10 and 11.

With reference to FIGS. 10, 11 and 12 applicator rod 20, forms part of an applicator unit 40, that also includes a container having a lid 44 and a base 52. Lid 44 and base 52 are made of lightweight, heavy duty rigid plastic. Mounted in lid 44 are two storage pipes 54 and 56 for storing applicator rod 20 and a second applicator rod 48 having the same construction as rod 20, but different dimensions. Also mounted on lid 44 are a hand pressure pump 46 and a hand vacuum pump 58.

A connecting hose 57 connects hand pressure pump 46 to a pressure valve 60. Similarly, a second connecting hose 59 connects hand vacuum pump 58 to vacuum valve 50. Vacuum valve 50 and pressure valve 60 are connected via a T-connector 61 which is also connected to inflating hose 66. Vacuum valve 50 may be moved from a closed position which allows for no air communication between hand vacuum pump 58 and inflating hose 66, to an open position allowing air communication between vacuum pump 58 and inflating hose 66.

Similarly, pressure valve 60 may be moved from a closed position wherein there is no air communication between pressure pump 46 and inflating hose 66, to an open position which allows for air communication between hand pressure pump 46 and inflating hose 66. Hose 42 extends from the air intake (not shown) of vacuum source 64 through an opening 53 in base 52. Hose 42 is connected at one end to engage an air intake of vacuum 64. Vacuum source 64 may be conveniently a conventional vacuum cleaner. Hose 42 has an opening (not shown) along its length, located proximate vacuum source 64. This opening in hose 42 is air sealed but allows inflating hose 66 to pass into the hollow interior passage of hose 42. Inflating hose 66 extends along and within the interior of hose 42 to a second end of hose 42. Second end of hose 42 is adapted to sealably connect to grip 21. Inflating hose 66 has an end which is adapted to connect to an end of hose 36.

Figure 13:
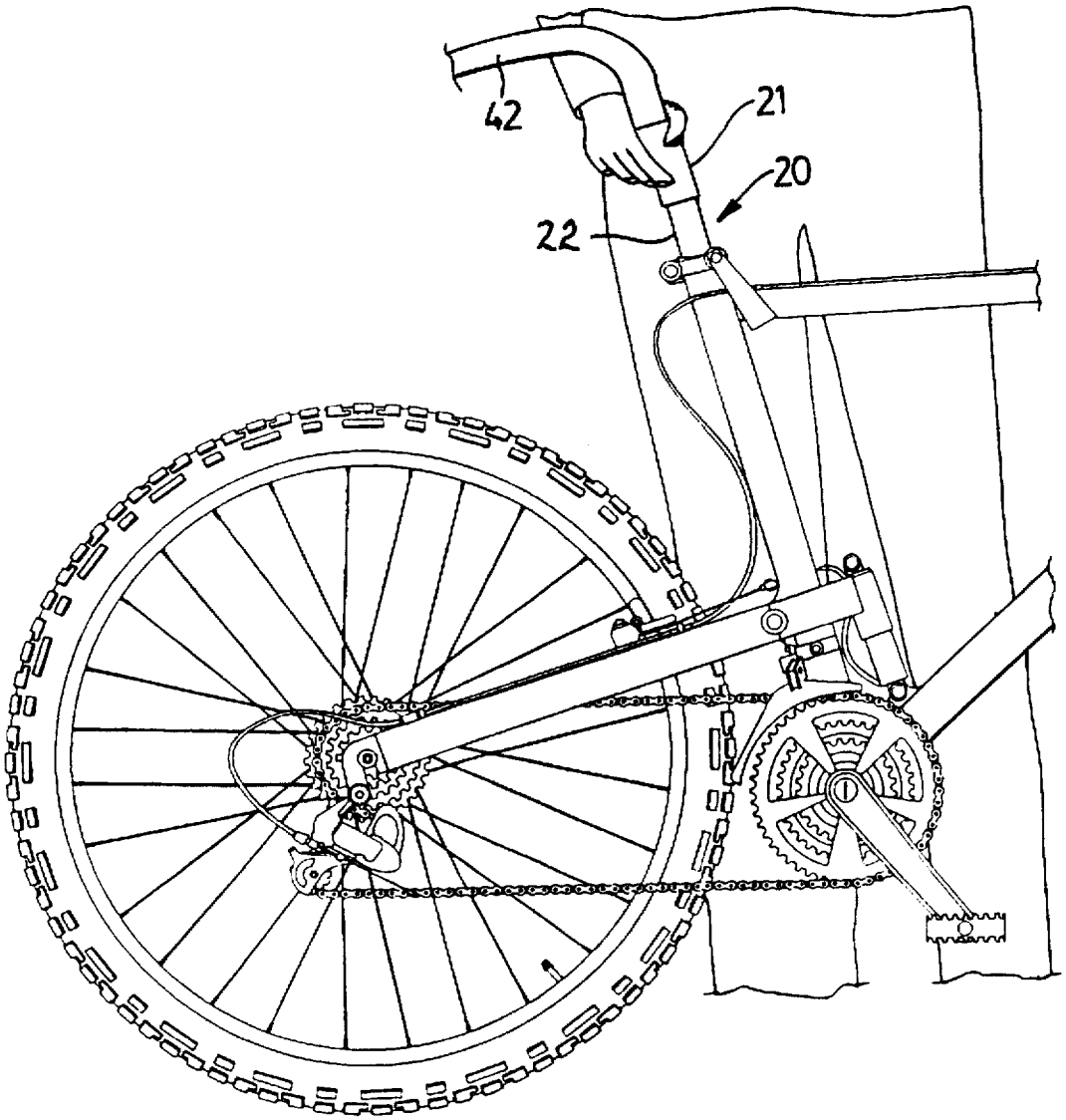
FIG. 13 illustrates one embodiment of the invention, used for the application of labels to the interior of a tube of a bicycle frame.

In operation, one of applicator rod 20 or 48 is chosen for applying a label to the interior of a hollow body having at least one opening. The opening to the hollow body is then made accessible. The applicator unit 40 may be used to apply a label to the interior surface of a tube forming part of a bicycle frame as shown in FIG. 13. Ideally, the label will be applied to the tube in which the bicycle seat is mounted. Accordingly, the seat is first removed to make the opening to the tube accessible.

Rod 20 or 48 is removed from storage pipe 54 or 56. Inflating hose 66 is then attached to hose 36. Hose 42 is then attached to applicator rod 20 or 48 via grip 21. Thereafter vacuum source 64 is activated. Holes 34 in grip 21 permit a constant flow of air to be drawn to vacuum source 64. Ideally, vacuum 64 will generate a vacuum draw of approximately 30–32" $H_2O$ at the plurality of openings 32. An information bearing label, made of plastic coated paper or the like, is placed on the exterior surface of shell 22 of rod 20 or 48, covering the holes 32 on the surface as shown in FIG. 2A. The negative pressure at holes 32 retains the label on the exterior surface of shell 22. Several of the holes 32 at the outer edges of the label are not entirely covered by the label. Thus an air flow is established at the edges of the label, which results in a force on those edges which thereby keeps these edges flat against the exterior surface of shell 22.

Next, pump valve 60 is closed and vacuum valve 50 is opened. Hand vacuum pump 58 is operated so as to ensure that inflatable bladder 28 is entirely deflated. This ensures that rod 20 can be inserted into the hollow body. Thereafter vacuum valve 50 is closed, thereby preventing air communication between inflatable bladder 28, hand vacuum pump 58, and hand pressure pump 46 effectively sealing inflatable bladder 28.

An adhesive material such as glue is applied to the surface of the label which is not in contact with the applicator. Alternatively, the label may have a self adhesive surface, in which case this self adhesive surface is used instead of, or in addition to, the glue. Applicator rod 20 or 48 is then inserted into the hollow body. Pump valve 60 is then opened, allowing air communication between hand pressure pump 46 and inflatable bladder 28. Hand pump 46 is operated to inflate bladder 28. Eventually the inflation of bladder 28 will result in a force being applied to the bladder by the outer surface of the body, as bladder 28 expands through opening 30 forcing the label against another part of the interior surface of the body opposite thereby pressuring the label against the interior surface of the hollow body. Semi-rigid vacuum line 26 must be stiff enough to resist the force transmitted to it. It will be apparent that vacuum line 26 will be under compression. The force exerted on vacuum line 26 is transmitted to shell 22. Preferably bladder 28 is inflated to 10 psi of pressure. Once bladder 28 has been inflated, pump valve 60 is closed to retain the pressure within inflatable bladder 28. Main vacuum 64 is then turned off. Applicator rod 20 or 48 may then be rotated about its own axis to ensure the label is properly adhered to the interior of the hollow body.

Thereafter, vacuum valve 50 is opened once again and hand vacuum pump 58 is operated to deplete the air from inflatable bladder 28. Applicator rod 20 or 48 can then be withdrawn from the hollow body.

It will be understood by a person skilled in the art that the above steps need not be performed in enumerated order. Numerous variations of the order are possible. Moreover, it will be understood that numerous modifications of the invention are possible. For example, the inflatable bladder need not be located on the interior of the applicator rod. It may be any inflatable member located exterior to the rod. Similarly, the rod need not have a circular cross section, but may have any cross section. Ideally, the cross section of the applicator rod will complement the shape of the interior surface of the hollow body.

Moreover, the invention may be adapted to apply a label to the interior of hollow surfaces having a multitude of shapes. For example, the invention could suitably be adapted to work with conical, circular or rectangular surfaces.

It will further be understood that the term "adhere" may refer to any form of adherence and need not be limited to the use of glue or the like. For example, the label may be shaped in such a manner and be sufficiently resilient to adhere itself to the interior of the hollow surface. Similarly, the hollow surface or the label may be magnetic.

Various other changes, alterations, and modifications, of the above preferred embodiment are possible without departing from the scope of the invention which is defined by the claims.

We claim:

1. An applicator for applying a label to an interior surface of a hollow body having at least one opening, said label having a first non-adhesive surface and an opposite adhering surface for adhering said label to said interior surface of said hollow body, said applicator comprising:

a rod comprising a shell defining a cavity for insertion into said hollow body through said opening, said shell comprising an outer surface, said shell outer surface having a hole extending therefrom into said cavity, said shell having a cut-away portion located substantially opposite said hole;

means for generating a vacuum at said hole to retain a label on said outer surface of said rod;

an inflatable bladder positioned in said cavity such that, when deflated, said rod when received in said opening may move freely in said hollow body, and when inflated, said bladder extends through said cut away portion to press against said interior surface, whereby a label at said hole is urged against a portion of said interior surface opposite thereto to adhere said label to said interior surface;

means to inflate said inflatable bladder;

means to deflate said inflatable bladder;

whereby, when said label is retained at said hole with said non-adhesive surface of said label in contact with said outer surface of said rod, said label and said rod are received in said opening, and said inflatable bladder is inflated, said label may be adhered to said inner surface.

2. The applicator of claim 1 wherein said means for generating a vacuum comprises a vacuum source connected to a vacuum line;

said vacuum line extends within said cavity of said rod;

said vacuum line has at least one opening adapted to overlap said hole, whereby a negative pressure may be generated at said hole.

3. The applicator of claim 2 wherein said vacuum source comprises a motorized vacuum pump.

4. The applicator of claim 1 wherein said means to inflate said inflatable bladder comprises an air pump, in communication with said inflatable bladder, and adapted to force air into said inflatable bladder.

5. The applicator of claim 4 wherein said means to deflate said inflatable bladder comprises a hand vacuum pump, in communication with said inflatable bladder, for extracting air from said inflatable bladder.

6. The applicator of claim 1 wherein said outer surface is rounded.

7. The applicator of claim 1 wherein said rod has a generally circular cross-section.

8. An applicator for applying a label to an interior surface of a hollow tube, said label having a first non-adhesive surface and an opposite adhering surface, said applicator comprising, a rod member having a shell enclosing a hollow, elongated cavity;

said shell having an outer surface, at least one hole extending into said hollow cavity from said outer surface, and a cut-away portion located substantially opposite said at least one hole;

a vacuum line extending along and within said hollow cavity of said rod, said vacuum line having at least one opening adapted to overlap said at least one hole in said shell;

a vacuum source for, with said vacuum line, generating a vacuum at said at least one hole to retain a label on said outer surface of said rod;

an inflatable bladder extending along and within said hollow cavity; and means to inflate said inflatable bladder from a first deflated state wherein said rod may be received in and move freely within said hollow tube, to a second inflated state wherein said inflatable bladder extends from said cut-away portion such that a label retained on said outer surface by a vacuum is forced against said interior surface of said hollow tube.

* * * * *